US007867030B2

(12) United States Patent
Clavier et al.

(10) Patent No.: US 7,867,030 B2
(45) Date of Patent: Jan. 11, 2011

(54) ELECTRONIC MODULE COMPRISING A SHIELDED CONNECTOR FIXED TO AN INTEGRATED CIRCUIT CARD BY MEANS OF A LUG FOR FIXING THE SHIELDING

(75) Inventors: Philippe Clavier, Bobigny (FR); Jean-Marc Nicolai, Courbevoie (FR)

(73) Assignee: Valeo Vision, Bobigny (FR)

( * ) Notice: Subject to any disclaimer, the term of this patent is extended or adjusted under 35 U.S.C. 154(b) by 21 days.

(21) Appl. No.: 12/246,719

(22) Filed: Oct. 7, 2008

(65) Prior Publication Data

US 2009/0091908 A1 Apr. 9, 2009

(30) Foreign Application Priority Data

Oct. 8, 2007 (FR) ..... 07 07058

(51) Int. Cl.
*H01R 24/00* (2006.01)

(52) U.S. Cl. ..... 439/607.01

(58) Field of Classification Search ..... 439/607.01, 439/607.13, 607.14, 620.02; 361/800, 818; 362/514, 363
See application file for complete search history.

(56) References Cited

U.S. PATENT DOCUMENTS 5,414,597 A * 5/1995 Lindland et al. ..... 361/816
5,500,789 A * 3/1996 Miller et al. ..... 361/816
6,347,038 B1 2/2002 Duarte et al.
6,490,171 B2 12/2002 Sievers et al.
6,659,799 B2 12/2003 Yang
6,688,913 B2 2/2004 Li
6,863,545 B2 * 3/2005 Peloza ..... 439/79
7,150,651 B1 12/2006 Yuan et al.
2002/0054485 A1 5/2002 Sievers et al.
2002/0081903 A1 6/2002 Yang
2003/0199194 A1 10/2003 Li
2006/0119282 A1 * 6/2006 Hackenbuchner et al. ... 315/209 R
2006/0291216 A1 * 12/2006 Blumel et al. ..... 362/362

FOREIGN PATENT DOCUMENTS

EP 1087652 A1 3/2001
EP 1182917 A1 2/2002
GB 2324201 A 10/1998
JP 3175698 A 7/1991

* cited by examiner

*Primary Examiner*—Alexander Gilman
(74) *Attorney, Agent, or Firm*—Jacox, Meckstroth & Jenkins

(57) ABSTRACT

The invention concerns an electronic module for converting electrical voltage that is intended to supply a light source, which comprises: a horizontal printed circuit card; at least one top connector fixed to the top face of the printed circuit card; an electromagnetic shielding jacket fixed to the connector; characterised in that the jacket comprises a bottom fixing lug that extends horizontally so as to be pressed on the top face of the printed circuit card, the connector being fixed to the card by means of the fixing lug.

23 Claims, 4 Drawing Sheets

ELECTRONIC MODULE COMPRISING A SHIELDED CONNECTOR FIXED TO AN INTEGRATED CIRCUIT CARD BY MEANS OF A LUG FOR FIXING THE SHIELDING

CROSS-REFERENCE TO RELATED APPLICATIONS

This application claims priority to French Application No. 0707058 filed Oct. 8, 2007, which application is incorporated herein by reference and made a part hereof.

BACKGROUND OF THE INVENTION

1. Field of the Invention

The invention concerns an electronic module for electrical voltage conversion that is intended to supply a light source of a headlight, in particular for a motor vehicle.

2. Description of the Related Art

In the automobile industry, use is being made more and more of headlights equipped with discharge lamps, such as xenon lamps, in particular to make them bright and for their longevity.

This type of lamp requires a high-voltage alternating electrical current supply. To control the supply of electric current to the lamp, the headlight comprises an electrical supply device that is equipped with a conversion electronic module, normally referred to as "ballast", which supplies, from a battery voltage of the motor vehicle, high alternating voltages that are adapted to the type of discharge lamp used.

Discharge lamps may emit a large quantity of electromagnetic radiation, the effect of which is undesirable both on the safety of operation of the other electronic circuits of the vehicle and on the radio environment in which the vehicle is travelling.

To remedy this drawback, it is known how to take several so called "EMC" measures, an acronym meaning "electromagnetic compatibility", separately or in combination according to circumstances, when the electrical supply device of the discharge lamp of the headlight is designed.

According to a first measure, it is known that some of the electromagnetic radiation is emitted by the ballast and by its connectors. This first measure for reducing the electromagnetic radiation emissions consists, as is known, of executing a shielding of the ballast and its connectors.

According to a second measure, the shieldings must be connected to a common reference electrical potential so that the various shieldings cannot vary in terms of voltage during use and thus change into parasitic radiating structures.

It is thus known how to equip the ballast with a shielding housing. Likewise, the connectors are equipped with a shielding jacket.

According to a known design, the housing and the jacket of the connector are electrically connected to the reference potential by means of a reference track of a printed circuit card of the ballast.

In this known design, the printed circuit card is fixed to the bottom of the housing by means of a fixing stud. This same fixing stud is also in electrical contact with the reference track in order to electrically connect the housing with the reference potential.

In this known design, the connector is fixed to the printed circuit card by lugs that pass through the card. The bottom end of these lugs, which is arranged under the printed circuit card, is conformed as a grapnel which, once twisted around the axis of the lugs, makes it possible to fix the connector to the printed circuit card. These same lugs are in electrical contact the jacket on the one hand and with the reference track on the other hand. Thus the jacket is electrically connected to the reference track by means of the lugs.

The method of producing the ballast comprises an operation of positioning the connector on the printed circuit card, and then an operation of fixing the connector. The lugs of the connector must then be soldered against the reference track of the printed circuit card, during a soldering operation, in order to provide permanent electrical contact. Finally, the printed circuit is positioned at the bottom of the housing during a positioning operation and then fixed during a fixing operation.

However, producing such a ballast is very expensive and requires many operations.

In addition, the operation of fixing the connector is complex to automate.

SUMMARY OF THE INVENTION

The invention proposes to resolve in particular these problems by proposing a module that is simple and rapid to produce.

The invention concerns more particularly an electronic module for electrical voltage conversion that is intended to supply a light source of a headlight, in particular for a motor vehicle, which comprises:

- a horizontal printed circuit card carrying electronic voltage conversion means;
- at least one top connector that is fixed to the top face of the printed circuit card;
- an electromagnetic shielding jacket that is fixed to the top connector;
- an electromagnetic shielding housing that encloses the printed circuit card and comprises a bottom against which the printed circuit card is fixed;
- the jacket and housing being electrically connected to a common reference electrical potential by means of a reference track of the printed circuit card.

Thus the object of the present invention is an electronic module for conversion of electrical voltage that is intended to supply a light source of a headlight, in particular for a motor vehicle, which comprises:

- a printed circuit card carrying electronic voltage conversion means;
- at least one top connector that is fixed to the top face of the printed circuit card;
- an electromagnetic shielding jacket that is fixed to the top connector;
- an electromagnetic shielding housing that encloses the printed circuit card and has a bottom against which the printed circuit card is fixed;
- the jacket and housing being electrically connected to a common reference electrical potential by means of a reference track of the printed circuit card; the jacket comprising a bottom fixing lug that extends so as to be pressed against the top face of the printed circuit card, the connector being fixed to the card by means of the fixing lug.

In the present application, in employing the terms "top" or "bottom", the bottom of the ballast is considered as a reference, whatever the orientation of this ballast. Thus, if two parts of an element or two elements are considered, the part of these two parts (or the element of these two elements) closest to the bottom of the ballast will be the bottom part (or the bottom element), and the part of these two parts (or the element of these two elements) furthest away from the bottom of the ballast will be the top part. In the present application, the bottom of the ballast or the bottom of the housing of the ballast means the face of the housing of the ballast against which the printed circuit card is fixed.

According to other characteristics of the invention:

- the jacket is in electrical contact with the reference track by means of the fixing lug;
- the printed circuit card is fixed to the bottom of the housing by fixing means produced from an electrically conductive material so that the housing is electrically connected to the reference track by means of the fixing means;
- the fixing lug is fixed by brazing, soldering or remelting on the printed circuit card;
- the soldering points are produced on the areas of contact between the fixing lug and the reference track;
- the fixing lug and the printed circuit card are fixed conjointly to the housing by the fixing means which fix the card to the housing;
- the fixing means are in electrical contact with the reference track by means of the fixing lug;
- the fixing means comprise a rod and a fixing head; the rod is fixed to the housing by a bottom end and passes through an opening in the printed circuit card; the fixing head is arranged a top end of the rod so as to grip the card against the housing;
- the orifice is bordered by the reference track;
- the fixing lug and the printed circuit card are fixed conjointly to the housing by the fixing means which fix the card to the housing so that the fixing lug is gripped between the fixing head and the top face of the printed circuit card;
- the fixing head is in electrical contact with the reference track by means of the fixing lug;
- the fixing means are formed by a screw that cooperates with a thread produced in the bottom of the housing;
- the fixing means are formed by a stud that extends vertically upwards from the bottom of the housing, and the head of which is produced by deformation of its free top end, such as by crimping;
- the light source of the headlight is a discharge lamp.

These and other objects and advantages of the invention will be apparent from the following description, the accompanying drawings and the appended claims.

Other characteristics and advantages will emerge during a reading of the following detailed description, for an understanding of which reference will be made to the accompanying drawings.

BRIEF DESCRIPTION OF THE ACCOMPANYING DRAWINGS

DETAILED DESCRIPTION OF THE PREFERRED EMBODIMENTS

In the following description, longitudinal orientations directed from rear to front, vertical directed from bottom to top and transverse directed from left to right, which are indicated by the trihedron "L,V,T" in FIGS. 2 to 7, will be adopted non-limitatively.

Hereinafter, elements having identical, analogous or similar functions will be indicated by the same reference numbers.

Figure 1:
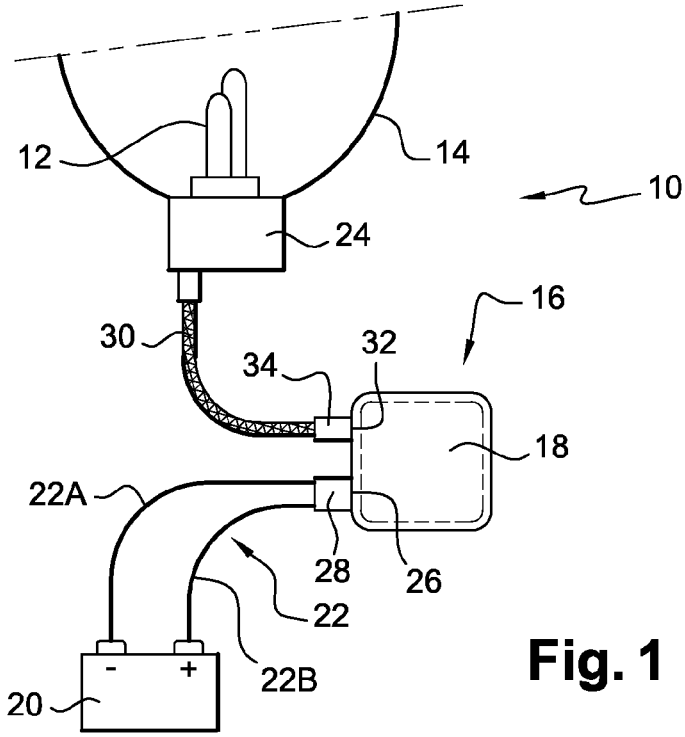
FIG. 1 is a schematic view that depicts a motor vehicle headlight comprising a discharge lamp supplied with electricity by means of a conversion module.

FIG. 1 depicts a motor vehicle headlight 10 that comprises a discharge lamp 12 arranged in a reflector 14. The discharge lamp 12 is here a bulb filled with a gas such as xenon at a high pressure, metal salts and halides in the solid state.

The discharge lamp 12 comprises means (not shown) for producing in the pressurized gas an electric arc for producing light. The means for producing the electric arc are supplied with electricity by an electrical supply device 16.

The supply device 16 comprises an electronic conversion module 18, which will be designated by the term "ballast" hereinafter according to the name normally used, which is supplied by a source of DC electric current 20 by means of a first cluster 22 supplying the ballast 18.

The source of DC electric current 20 is formed by a motor vehicle battery 20 that has a positive terminal and a negative terminal, designated respectively by the symbols "+" and "−" in FIG. 1.

The ballast 18 comprises more particularly an input connector 26 in which a first reciprocal end connector 28 of the supply cluster 22 is engaged mechanically in an electrically connected position.

The supply cluster 22 is formed by two insulated conductive wires 22A, 22B, which each have a first end electrically connected to an associated terminal of the battery 20 and a second end equipped with a plug in the form of a clamp forming the first reciprocal end connector 28.

Figure 5:
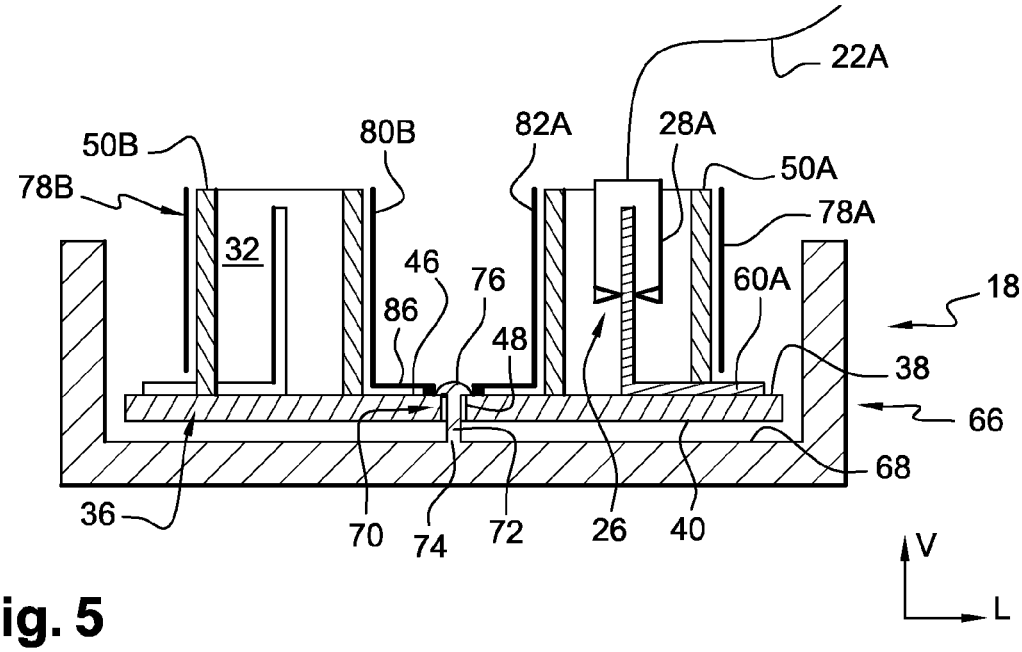
FIG. 5 is a view in section along the cutting plane 5-5 of FIG. 4.
Figure 7:
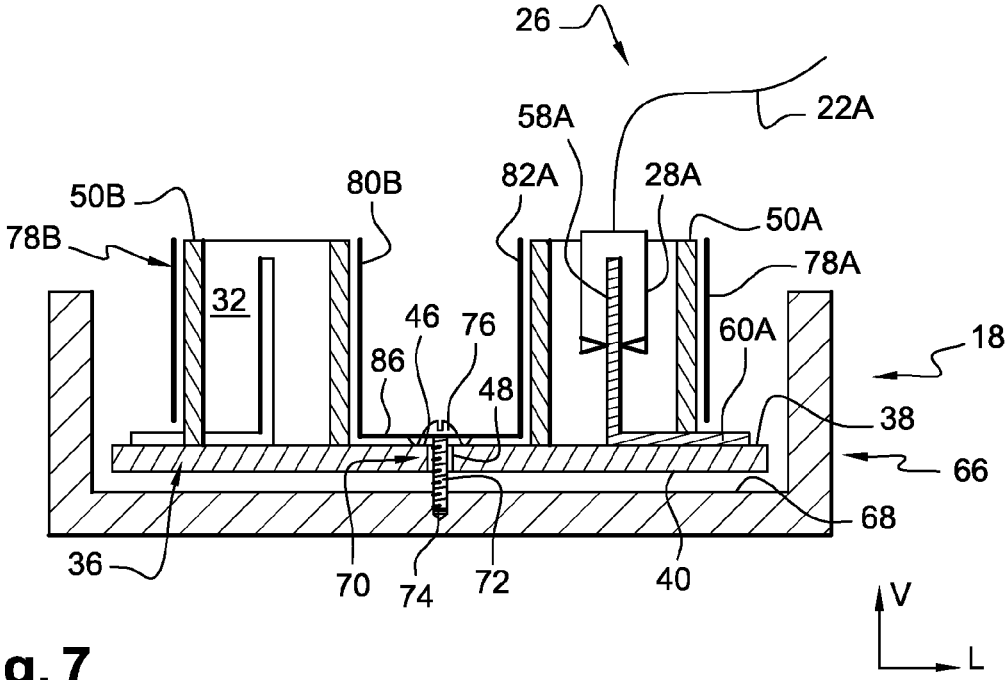
FIG. 7 is a view in section along the cutting plane 7-7 in FIG. 6.

The first reciprocal end connector 28 thus comprises a first negative plug 28A electrically connected to the negative terminal, as shown in FIGS. 5 and 7, and a second positive plug (not shown) electrically connected to the positive terminal.

The electronic conversion module 18 is intended to convert the DC electric current from the battery 20 into an AC electric current able to supply the discharge lamp 12 by means of a second electrical connection cluster 30.

The supply device 16 is also equipped with a high-voltage starter module 24 interposed in the electrical circuit between the ballast 18 and the discharge lamp 12. In the example shown in FIG. 1, the discharge lamp 12 and the starter module 24 form a compact assembly.

The ballast 18 comprises an output electrical connector 32 in which a first reciprocal output connector 34 of the connection cluster 30 is mechanically engaged in an electrically connected position.

The reciprocal output connector 34 comprises more particularly a plurality of plugs (not shown) of similar appearance to those of the plugs 28A (FIG. 6) of the supply cluster 22 that are electrically connected to each of the conductive wires constituting the connecting cluster 30. The plugs of the reciprocal output connector 34 are stored transversely in a hollow paved support (not shown) of the reciprocal output connector 34.

Figure 2:
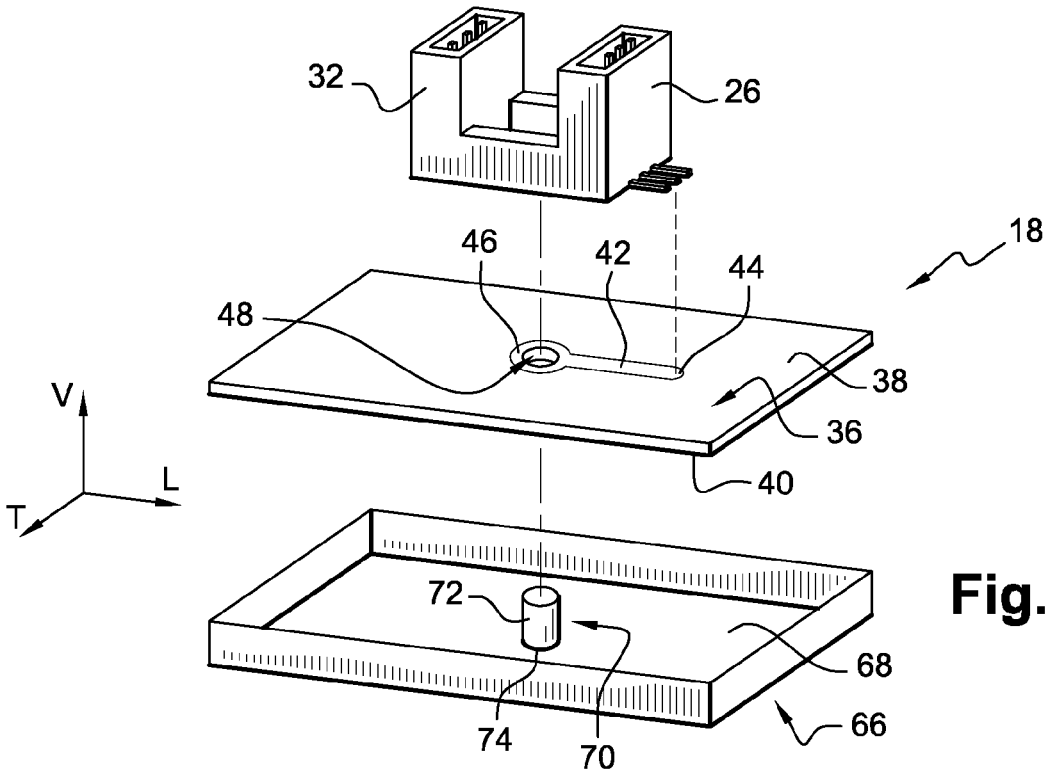
FIG. 2 is a view in exploded perspective that depicts the conversion module produced according to the teachings of the invention.

The ballast 18 has been shown in more detail in FIG. 2.

The ballast 18 comprises a printed circuit card 36 which, as shown and by way of example, extends in a horizontal plane. The printed circuit card 36 comprises a top face 38 and a bottom face 40.

The printed circuit card 36 carries on its top face 38 electrical tracks and electronic means (not shown) for converting the voltage. A so-called reference electrical track 42 extends longitudinally from a first front end 44 as far as a rear end 46 in the form of a ring that surrounds a circular fixing orifice 48 that passes vertically through the printed circuit card 36. In FIG. 2, for reasons of clarity, only the reference track 42 is shown.

The first input connector 26 and the second output connector 32 are fixed to the top face 38 of the printed circuit card 36. The reciprocal input 28 and output 34 connectors are intended to be inserted in the associated input 26 and output 32 connectors in a connected position by a vertical translation movement from top to bottom.

More particularly, the input connector 26 is arranged longitudinally in front of the fixing orifice 48, close to the front end 44 of the reference track 42, while the second output connector 32 is arranged longitudinally at the rear of the fixing orifice 48. Thus the fixing orifice 48 is interposed longitudinally between the first input connector 26 and the second output connector 32.

Figure 3:
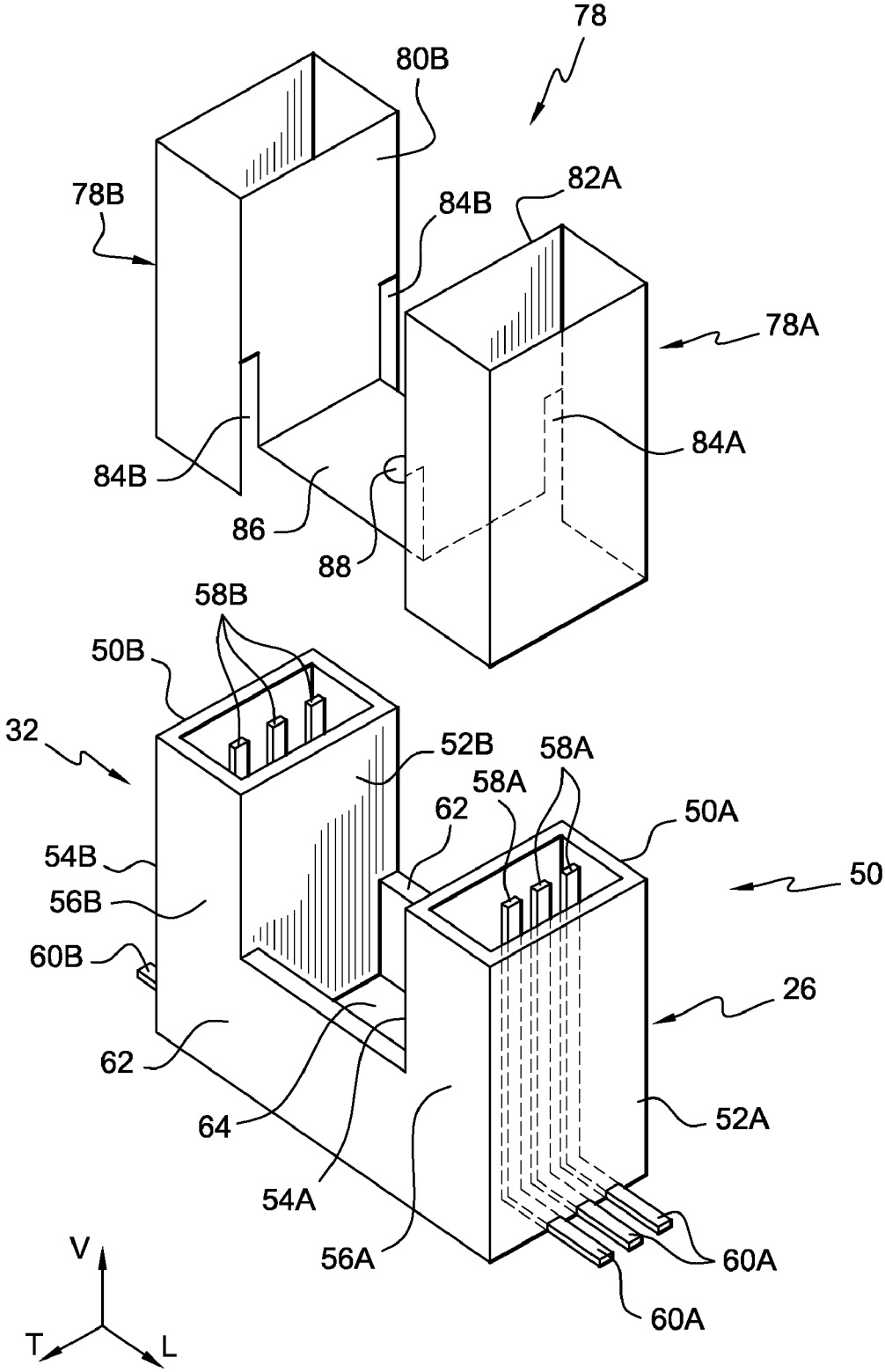
FIG. 3 is a view in exploded perspective that depicts two connectors of the conversion module of FIG. 2 equipped with shielding.

As shown in more detail in FIG. 3, the input 26 and output 32 connectors have a substantially identical appearance. The description of the connector 26, 32 that follows will therefore be applicable to each of the input 26 and output 32 connectors. Hereinafter, the reference numbers designating a structural element of the input connector 26 will be followed by the letter "A", while the reference numbers designating a structural element of the output connector 32 will be followed by the letter "B".

Each connector 26, 32 comprises a tubular sleeve 50A, 50B that extends vertically upwards from a bottom rectangular horizontal edge as far as a top rectangular horizontal edge.

The sleeve 50A, 50B has a rectangular horizontal section. The sleeve 50A, 50B thus has a front external vertical face 52A, 52B, a rear external vertical face 54A, 54B and two external lateral vertical faces 56A, 56B. The bottom edge of the sleeve 50A, 50B is intended to be arranged against the top face 38 of the printed circuit card 36.

The sleeve 50A, 50B is intended to guide the movement of the associated reciprocal connector 28, 34 towards its connected position and to hold the reciprocal connector 28, 34 horizontally in its connected position.

Each sleeve 50A, 50B is for example produced from a rigid plastics material.

A plurality of electrical contact plugs 58A, 58B in the form of vertical rods are fixed inside each sleeve 50A, 50B. Each sleeve 50A, 50B is here equipped with three plugs 58A, 58B.

Each plug 58A, 58B has a free top end that is intended to be gripped by an associated plug of complementary shape of the associated reciprocal connector 28, 34, and a bottom end arranged level with the bottom edge of the associated sleeve 50A, 50B.

Each plug 58A, 58B is in electrical contact with an associated horizontal electrical contact lug 60A, 60B that extends longitudinally projecting from a bottom edge of a longitudinal external face of the sleeve 50A, 50B as far as a free end. More particularly, the contact lugs 60A of the input connector 26 extend towards the front from the bottom edge of the front external vertical face 52A of the input connector 26, while the contact lugs 60B of the output connector 32 extend towards the rear from the bottom edge of the rear vertical face 54B of the output connector 32.

Each contact lug 60A, 60B is in particular intended to be electrically connected to an associated track on the printed circuit card 36, for example by soldering or brazing of the contact lug 60A, 60B against the associated track on the printed circuit card 36. More particularly, the contact lug 60A corresponding to the negative plug 28A of the supply cluster 22 that is shown in the center of the figures is electrically connected to the reference track 42.

In the examples shown in FIGS. 2 to 7, the input 26 and output 32 connectors are produced in one piece in a single block 50. To this end, two left and right vertical wings 62 extend longitudinally from the front face 52B of the sleeve 50B of the output connector 32 as far as the rear face 54A of the sleeve 50A of the input connector 26 in order to mechanically connect the two input 26 and output 32 connectors. Each wing 62 extends more particularly in line with the lateral faces 56A, 56B of the two sleeves 50A, 50B.

The block 50 of connectors 26, 32 thus has a central window 64 that is delimited transversely by the two wings 62 and longitudinally by the front face 52B of the sleeve 50B of the output connector 32 and by the rear face 54A of the sleeve 50A of the input connector 26.

Figure 4:
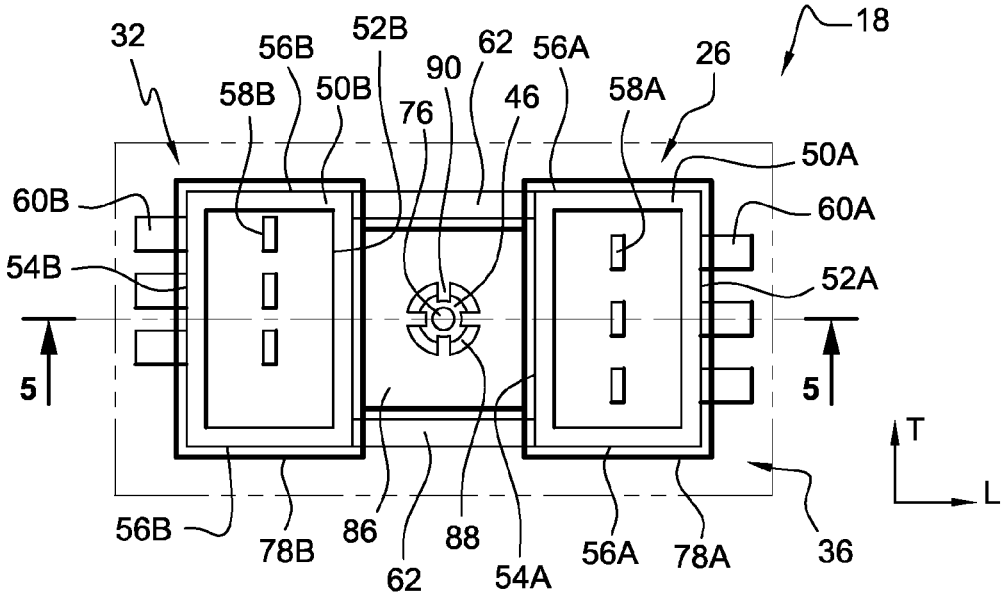
FIG. 4 is a plan view that depicts the connectors arranged in the connection module according to a first embodiment of the invention.

As shown in FIG. 4, when the block 50 of connectors 26, 32 is fixed to the printed circuit card 36, the fixing orifice of the printed circuit card 36 emerges inside the window 64.

The electronic conversion means are liable to emit parasitic electromagnetic radiation. To prevent the propagation of this parasitic radiation in the cabin of the motor vehicle, the printed circuit card 36 is enclosed in an electromagnetic shielding housing 66, as illustrated in FIG. 2.

To this end, the housing 66 is produced from a rigid electrically conductive material.

In order to improve further the effect of the electromagnetic shielding, the housing 66 is connected to a reference electrical potential that is formed by the negative potential of the battery 20.

The housing 66 is produced in a first bottom part depicted in FIG. 2 and a top cover part (not shown) that is perforated to allow access to the input 26 and output 32 connectors. When the housing 66 is closed, its two parts are in electrical contact with each other to allow their connection to the common reference potential.

The bottom part of the housing 66 comprises an internal horizontal bottom 68 against which the bottom face 40 of the printed circuit card 36 is fixed.

The printed circuit card 36 is fixed to the bottom 68 of the housing 66 by fixing means 60 that comprise:

- at least one vertical fixing rod 72 that is fixed to the bottom 68 of the housing 66 by its bottom end 74 and passes through the fixing orifice of the printed circuit card 36;
- and a top fixing head 76 that is arranged at a top end of the fixing rod 72 so as to grip the printed circuit card 36 against the bottom 68 of the housing 66.

In the example shown in FIG. 2, the fixing rod 72 is formed by a vertical stud that is fixed to the bottom 68 of the housing 66. The stud 72 is inserted in the fixing orifice of the printed circuit card 36 in order to facilitate its positioning. Then the fixing head 76 is produced by deformation of the free top end like a fixing rivet, by crimping, as shown in FIG. 5.

The orifice being bordered by the reference track 42, the bottom annular face of the head 76 of the stud 72 is in electrical contact with the reference track 42. The fixing stud 72 is produced from an electrically conductive material so that the housing 66 is electrically connected to the reference track 42, and thus to the reference potential, by means of the fixing means 70.

Advantageously, the stud 72 is produced in one piece with the bottom 68 of the housing 66.

To prevent parasitic radiation escaping through the input 26 and output 32 connectors, an electromagnetic shielding jacket 78A, 78B is fixed to each of the input 26 and output 32 connectors, for example by adhesive bonding, riveting, snapping on or any other suitable fixing means.

As shown in FIG. 3, each jacket 78A, 78B is produced from a sheet of conductive material that is folded so as to cover the external vertical faces 52, 54, 56 of the associated sleeve 50A, 50B. Each jacket 78A, 78B thus has the appearance of a tube with a rectangular horizontal section.

The front face 80B of the jacket 78B of the output connector 32 and the rear face 82A of the jacket 78A of the input connector 26 comprise lateral bottom scallops 84A, 84B that straddle the wings 62 of the block 50 of connectors 26, 32.

According to the teachings of the invention, at least one of the jackets 78A, 78B has a bottom fixing lug 86 by means of which the block 50 of connectors 26, 32 is fixed to the printed circuit card 36. The fixing lug 86 is in the form of a horizontal plate that extends in the horizontal plane of the bottom edges of the sleeves 50A, 50B of the connectors 26, 32. The bottom face of the fixing lug 86 is pressed against the top face 38 of the printed circuit card 36.

The fixing lug 86 extends more precisely through the window 64 in the block 50 of connectors 26, 32.

Advantageously, the bottom fixing lug 86 is produced in one piece with the associated jacket 78A, 78B.

In the examples shown in FIGS. 2 to 7, the bottom fixing lug 86 is common to the two jackets 78A, 78B. It is mechanically connected by its rear edge to the front face 80B of the jacket 78B of the output connector 32 and by its front edge to the rear face 82A of the jacket 78A of the input connector 26. The two jackets 78A, 78B and the bottom fixing lug 86 are thus produced in a single piece made from the same material, and the bottom fixing lug 86 is in electrical contact simultaneously with the two jackets 78A, 78B.

In this configuration, the bottom fixing lug 86 closes off the window 64 of the block 50 of connectors 26, 32. It comprises a central opening 88 that coincides with the fixing orifice of the printed circuit card 36 to allow passage of the fixing rod 72 of the printed circuit card 36. The opening 88 here has a circular-shaped periphery.

According to a first embodiment of the invention shown in FIGS. 4 and 5, the opening 88 is sufficiently wide for the fixing lug 86 not to be interposed vertically between the fixing head 76 and the printed circuit card 36 after the operation of fixing the printed circuit card 36. In other words, the fixing head 76 is directly in contact with the reference track 42 of the printed circuit card 36.

As shown in FIGS. 4 and 5, the block 50 of connectors 26, 32 is fixed to the printed circuit card 36 by means of the fixing lug 86 of the shielding jackets 78A, 78B.

The fixing lug 86 is fixed to the top face 38 of the printed circuit card 36 by soldering, brazing, remelting or any other similar fixing method. The soldering points are more particularly arranged on the periphery of the opening 88 of the fixing lug 86.

Each jacket 78A, 78B is also connected electrically to the common reference potential by means of the reference track 42 of the printed circuit card 36. The jacket 78A, 78B is more particularly in electrical contact with the reference track 42 by means of the fixing lug 86.

To facilitate electrical contact between the fixing lug 86 and the reference track 42, the periphery of the opening 88 has toes 90 that extend horizontally as far as in line with the reference track 42 around the fixing orifice. The fixing soldering points are produced at the free end of the toes 90, that is to say in the area of contact between the fixing lug 86 and the annular rear end 46 of the reference track 42.

Thus the soldering points produced at the toes 90 make it possible simultaneously to fix the block 50 of connectors 26, 32 to the printed circuit card 36 on the one hand and to provide permanent electrical contact between the fixing lug 86 and the reference track 42 on the other hand. The electrical connection of the jackets 78A, 78B to the reference track 42 and the mechanical fixing of the block 50 of connectors 26, 32 to the printed circuit 36 are thus achieved in a single operation.

According to a variant embodiment of the invention depicted in FIG. 7, the stud 72 is replaced by a vertical screw that is screwed into a thread coinciding with the fixing orifice of the printed circuit card 36. The screw is then produced from an electrically conductive material.

The operations of producing the ballast 80, according to the various embodiments described above, are disclosed below.

When the ballast 18 is produced, during a first operation of positioning the connectors 26, 32, the block 50 of connectors 26, 32 is positioned against the top face 38 of the printed circuit card 36 so that the opening 88 in the fixing lug 86 coincides with the fixing orifice of the printed circuit card 36, and so that the contact lug 60A of the negative plug 58A is pressed against the front end 44 of the reference track 42. The toes 90 of the opening 88 of the fixing lug 86 are then in electrical contact with the periphery of the rear end 46 of the reference track 42.

Then, during a second operation of fixing the connectors 26, 32 the contact lug 60A of the negative 58A and the fixing lug 86 of the block 50 of connectors 26, 32 are fixed by soldering, brazing or remelting, against the printed circuit card 36. The block 50 of connectors 26, 32 is thus mechanically fixed to the printed circuit card 36, and the jacket 78A, 78B shielding the connectors 26, 32 is in electrical contact with the contact lug 60A of the negative plug 58A.

Advantageously, during this operation of fixing the connectors 26, 32, other electronic elements are fixed by brazing or soldering to the top face 38 of the printed circuit card 36.

Then, during a third operation of positioning the printed circuit card 36, the printed circuit card 36 is arranged on the bottom 68 of the housing 66 by inserting the stud 72 in the fixing orifice.

Finally, during a fourth operation of fixing the printed circuit card 36, the top end of the rod 72 of the stud is deformed so as to form a fixing head 76 that presses the printed circuit card 36 against the bottom 68 of the housing 66. The bottom annular surface of the fixing head 76 is in electrical contact with an internal annular portion of the rear end 46 of the reference track 42.

Thus the ballast 18 produced according to the teachings of the invention makes it possible, in a single remelting operation, to effect the fixing of the block 50 of connectors 26, 32 to the printed circuit card 36 and to provide electrical contact between the shielding jackets 78A, 78B and the reference track 42.

Such a ballast 18 also has the advantage of a certain flexibility in the production process. Thus the second remelting operation can occur after the fourth fixing operation since the fixing lug 86 is arranged above the printed circuit card 36. It is therefore accessible even when the printed circuit card 36 is arranged in the housing 66.

Figure 6:
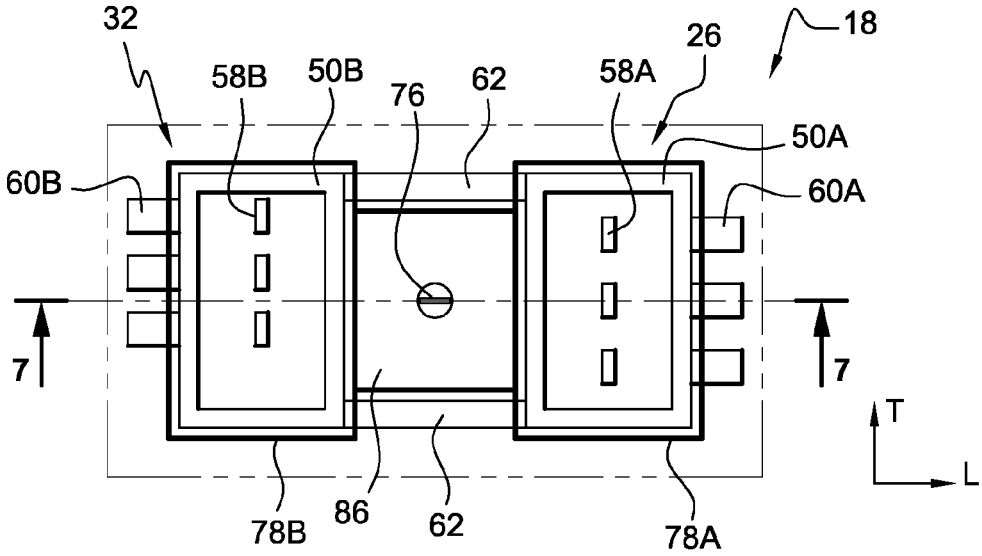
FIG. 6 is a view similar to that of FIG. 4 that depicts the connectors arranged according to a second embodiment of the invention.

According to a second embodiment of the invention depicted in FIGS. 6 and 7, the fixing lug 86 and the printed circuit card 36 are fixed conjointly to the housing 66 by common fixing means 70. The fixing means 70 are the means 70 of fixing the printed circuit card 36 to the housing 66 described in the first embodiment so that the fixing lug 86 is fixed by vertical gripping between the fixing head 76 and the top face 38 of the printed circuit card 36.

In the example shown in FIGS. 6 and 7, the fixing means 70 are formed by a screw having a threaded shank 72, the free bottom end 74 of which is screwed in a thread produced in the bottom 68 of the housing 66. The top head of the screw forms the fixing head 76 for the printed circuit card 36.

According to a variant, not shown, of the invention, the common fixing means 70 can also be formed by a riveted stud as described in the first embodiment of the invention.

As shown in FIG. 8, the opening 88 in the fixing lug 86 has a profile with a shape and dimensions identical to those of the fixing orifice of the printed circuit card 36. Thus, when the bottom face of the fixing lug 86 is pressed against the top face 38 of the printed circuit card 36, the opening 88 coinciding with the fixing orifice, the fixing lug 86 totally covers the reference track 42.

Thus, when the fixing head 78 is gripped vertically downwards against the top face 38 of the printed circuit card 36, the fixing lug 86 is interposed between the fixing head 76 and the reference track 42. The fixing lug 86 is therefore fixed by gripping between the fixing head 76 and the top face 38 of the printed circuit card 36.

In addition the fixing head 76 is in electrical contact with the reference track 42 by means of the fixing lug 86.

Thus, when the ballast 18 is produced, the printed circuit card 36 is positioned at the bottom 68 of the housing 66 so that the fixing orifice coincides with the thread at the bottom 68 of the housing 66 during a first positioning operation. Then the block 50 of connectors 26, 32 is positioned on the top face 38 of the printed circuit card 36 so that the opening 88 coincides with the fixing with the orifice.

Then, during a second fixing step, the fixing screw is inserted in the orifice, passing through the opening and the fixing orifice. The screw is then screwed until its top fixing head 76 is in contact with the fixing lug 86 in order to grip conjointly the fixing lug 86 and the printed circuit card 36 against the bottom 68 of the housing 66.

The fixing lug 86 and the printed circuit card 36 are then immobilized with respect to the housing 66, and therefore with respect to each other.

In addition, the housing 66 is in electrical contact with the reference track 42 by means of the fixing lug 86 and the screw.

According to a variant, not shown, of the second embodiment of the invention, and by analogy with FIG. 4, the opening 88 in the fixing lug 86 has a diameter greater than that of the fixing head 76. However, the opening 88 has toes 90 that extend radially towards the inside of the opening 88 so that a free end of the toes 90 is interposed between the fixing head 76 and the top face 38 of the printed circuit card 36. Thus, the bottom annular face of the fixing head 76 is in direct contact with the reference track 42 on certain portions, while on the other portions it is in contact with the reference track 42 by means of the toes 90 of the fixing lug 86.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. An electronic module for electrical voltage conversion that is intended to supply a light source of a headlight, in particular for a motor vehicle, which comprises:

a printed circuit card carrying electronic voltage conversion means;

at least one top connector that is fixed to a top face of the printed circuit card, said at least one top connector having a plurality of non-conductive sleeves that surround a plurality of plugs, respectively;

an electromagnetic shielding jacket that is fixed to the at least one top connector;

an electromagnetic shielding housing that encloses the printed circuit card and comprises a bottom against which the printed circuit card is fixed;

the electromagnetic shielding jacket and said electromagnetic shielding housing being electrically connected to a common reference electrical potential by means of a reference track on a top face of the printed circuit card;

said electromagnetic shielding jacket being adapted to at least partially surround an outer surface of said plurality of non-conductive sleeves;

wherein the electromagnetic shielding housing comprises a bottom fixing lug that extends so as to be pressed against the top face of the printed circuit card, the at least one top connector being fixed to the printed circuit card by means of the bottom fixing lug extending through said electromagnetic shielding jacket to secure said electromagnetic shielding jacket and said at least one connector to said electromagnetic shielding housing such that said electromagnetic shielding jacket and said electromagnetic shielding housing are in direct contact with said reference track.

2. The electronic module according to claim 1, wherein the electromagnetic shielding jacket is in electrical contact with the reference track by means of the bottom fixing lug.

3. The electronic module according to claim 2, wherein a printed circuit card is fixed to the electromagnetic shielding housing by fixing means produced from an electrically conductive material so that the electromagnetic shielding housing is electrically connected to the reference track by means of the fixing means.

4. The electronic module according to claim 2, wherein the bottom fixing lug is fixed by brazing, soldering or remelting on a printed circuit card.

5. The electronic module according to claim 2, wherein soldering points are produced on areas of contact between the bottom fixing lug and the reference track.

6. The electronic module according to claim 1, wherein the printed circuit card is fixed to the electromagnetic shielding housing by fixing means produced from an electrically conductive material so that the electromagnetic shielding housing is electrically connected to the reference track by means of the fixing means.

7. The electronic module according to claim 6, wherein the bottom fixing lug and the printed circuit card are fixed conjointly to the electromagnetic shielding housing by the fixing means which fix the printed circuit card to the electromagnetic shielding housing.

8. The electronic module according to claim 7, wherein said fixing means are in electrical contact with the reference track by means of the bottom fixing lug.

9. The electronic module according to claim 6, wherein said fixing means comprise:

a rod that is fixed to the bottom of the electromagnetic shielding housing by its bottom end, and that passes through an orifice in the printed circuit card;

and a fixing head that is arranged at a top end of the rod so as to grip the printed circuit card against the electromagnetic shielding housing by pressing on the reference track.

10. The electronic module according to claim 9, wherein said orifice is bordered by the reference track.

11. The electronic module according to claim 9, wherein the bottom fixing lug and the printed circuit card are fixed conjointly to the electromagnetic shielding housing by said fixing means which fix the printed circuit card to the electromagnetic shielding housing so that the bottom fixing lug is gripped between the fixing head and a top face of the printed circuit card.

12. The electronic module according to claim 11, wherein said fixing head is in electrical contact with the reference track by means of the bottom fixing lug.

13. The electronic module according to claim 6, wherein the fixing means are formed by a screw that cooperates with a thread produced in the bottom of the electromagnetic shielding housing.

14. The electronic module according to claim 6, wherein the fixing means are formed by a stud that extends vertically upwards from the bottom of the electromagnetic shielding housing, and a fixing head of which is produced by deformation of its free top end, such as by crimping.

15. The electronic module according to claim 1, wherein the bottom fixing lug is fixed by brazing, soldering or remelting on the printed circuit card.

16. The electronic module according to claim 1, wherein soldering points are produced on areas of contact between the bottom fixing lug and the reference track.

17. The electronic module according to claim 1, wherein the light source of the headlight is a discharge lamp.

18. An electronic module for electrical voltage conversion that is intended to supply a light source of a headlight, in particular for a motor vehicle, which comprises:

a printed circuit card carrying electronic voltage conversion means;

at least one top connector that is fixed to a top face of the printed circuit card, said at least one top connector having a plurality of non-conductive sleeves that surround a plurality of plugs, respectively;

an electromagnetic shielding jacket that is fixed to the at least one top connector;

said electromagnetic shielding jacket being electrically connected to a common reference electrical potential by means of a reference track on a top face of the printed circuit card;

said electromagnetic shielding jacket being adapted to at least partially surround an outer surface of said plurality of non-conductive sleeves;

wherein the electromagnetic shielding jacket comprises a bottom fixing lug that extends so as to be pressed against the top face of the printed circuit card, the at least one top connector being fixed to the printed circuit card by means of the bottom fixing lug extending through said electromagnetic shielding jacket to secure said electromagnetic shielding jacket and said at least one connector to said electromagnetic shielding housing such that said electromagnetic shielding jacket and said electromagnetic shielding housing are in direct contact with said reference track.

19. The electronic module according to claim 18, wherein the electromagnetic shielding jacket is in electrical contact with the reference track by means of the bottom fixing lug.

20. The electronic module according to claim 18, wherein the printed circuit card is fixed to a electromagnetic shielding housing by fixing means produced from an electrically conductive material so that the electromagnetic shielding housing is electrically connected to the reference track by means of the fixing means.

21. The electronic module according to claim 18, wherein the bottom fixing lug is fixed by brazing, soldering or remelting on the printed circuit card.

22. The electronic module according to claim 18, wherein soldering points are produced on areas of contact between the bottom fixing lug and the reference track.

23. The electronic module according to claim 20, wherein the bottom fixing lug and the printed circuit card are fixed conjointly to the electromagnetic shielding housing by the fixing means which fix the printed circuit card to the electromagnetic shielding housing.

* * * * *